United States Patent [19]

Furuya

[11] 4,430,054

[45] Feb. 7, 1984

[54] OIL-WATER MIXING AND SUPPLYING SYSTEM

[75] Inventor: Mitsumasa Furuya, Tokyo, Japan

[73] Assignee: Nihon Eikan Shido Center Co., Ltd., Tokyo, Japan

[21] Appl. No.: 323,173

[22] Filed: Nov. 19, 1981

[30] Foreign Application Priority Data

Dec. 20, 1980 [JP] Japan ..... 55-180802

[51] Int. Cl.[3] ..... F23J 7/00

[52] U.S. Cl. ..... 431/4; 137/567; 366/137

[58] Field of Search ..... 431/4, 12, 90; 137/563, 137/567, 568, 569; 366/137

[56] References Cited

U.S. PATENT DOCUMENTS

| | | | |
|---|---|---|---|
| 3,122,419 | 2/1964 | Henderson | 137/563 X |
| 3,637,136 | 1/1972 | Bok | 137/563 X |
| 3,676,075 | 7/1969 | Ploger et al. | 366/137 X |
| 3,837,784 | 9/1974 | Delatsonchette | 431/4 |
| 3,876,363 | 4/1975 | LaHaye et al. | 431/210 X |
| 3,958,915 | 5/1976 | Noda et al. | 431/4 X |
| 4,117,550 | 9/1978 | Folland et al. | 137/563 X |
| 4,144,015 | 3/1979 | Berthiaume | 431/4 X |
| 4,186,769 | 2/1980 | Buyce | 137/568 X |
| 4,340,079 | 7/1982 | Smith et al. | 137/568 X |
| 4,345,715 | 8/1982 | van Craenenbroeck | 137/568 X |

FOREIGN PATENT DOCUMENTS

| | | | |
|---|---|---|---|
| 1595591 | 8/1981 | United Kingdom | 137/569 |

OTHER PUBLICATIONS

Facilities Engineering, "Plant Engineering" (Jan. 23, 1975).

Continuous, Predictable Performance with Motionless Mixers, "Automation" (Feb., 1972).

*Primary Examiner*—Daniel J. O'Connor
*Assistant Examiner*—Carl D. Price
*Attorney, Agent, or Firm*—Holman & Stern

[57] ABSTRACT

An apparatus for continuously emulsifying an oil-water mixture supplied to a burner, having a first flow circuit when the burner is operative and a second flow circuit when the burner is inoperative.

1 Claim, 5 Drawing Figures

OIL-WATER MIXING AND SUPPLYING SYSTEM

BACKGROUND OF THE INVENTION

This invention relates to a system to mix oil and water to produce an emulsified mixture and deliver it to the burner.

In conventional systems of this kind, as shown in FIG. 1, the oil, water and emulsifier are supplied by the constant flow pumps P1, P2 and P3 to the emulsifying tank T1 where they are mixed by the agitator M to be emulsified, and then the mixture is delivered by the pump P4 to the auxiliary storage tank T2, from which it is sent to the burner $B_P$ having a pump. The excess fuel which was not burned in the burner is returned to the auxiliary tank T2.

The system with the above construction has various drawbacks. The fuel, after being thoroughly mixed for 5 to 10 minutes in the tank T1, is intermittently supplied to the auxiliary tank T2 and therefore it is diffucult to have as much fuel as is necessary for the burner supplied by the pump P4 to the auxiliary tank T2. For this reason, the emulsified fuel staying in the auxiliary tank T2 is liable to become separated into oil and water. Since the system requires two tanks, the emulsifying tank T1 and the auxiliary tank T2, the system is subject to the regulation of fire laws (according to the volume of tanks) for the purpose of preventing fire.

The emulsified fuel in the tank T1 is transferred to the auxiliary tank T2 to stabilize it. However, if the fuel is left in the Tank T2 for more than a certain period of time, the emulsion may become separated into oil and water, bringing bad effects on the combustion. The fuel mixture that has been returned from the burner to the auxiliary tank T2 will also become separated with the lapse of time. This separation can easily occur especially with light oils (A-heavy oil, kerosene, etc.). Furthermore, since the system must be equipped with tanks, it is unavoidable that the size of the system becomes large. In the conventional method, the emulsifier must be added in the emulsifying tank T1, while this invention does not require the emulsifier because the emulsifying time is so short that it is possible to supply the emulsion fuel to the burner before it is separated.

This invention has been accomplished to overcome the aforementioned drawbacks of the conventional system and it will be explained referring to the accompanying drawings.

DETAILED DESCRIPTION OF THE DRAWINGS

Figure 2:
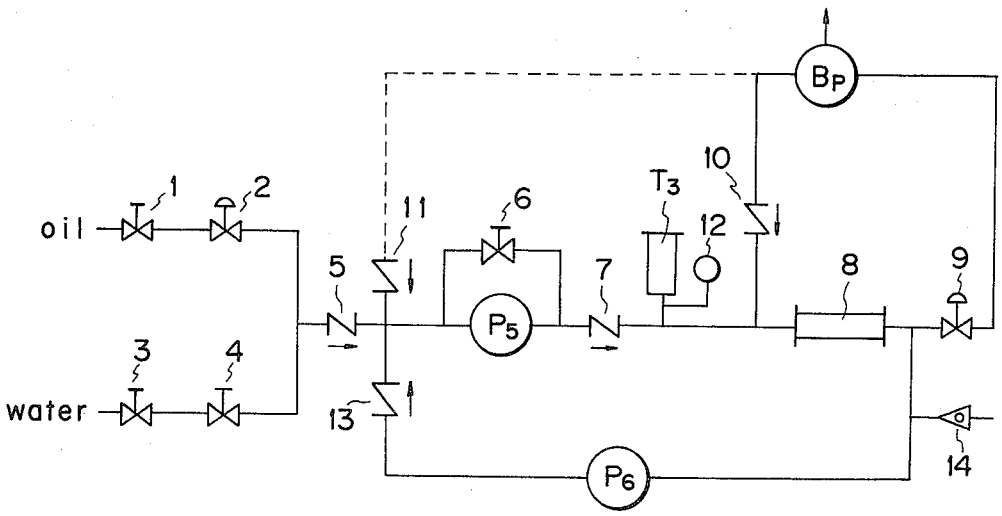
FIG. 2 is a circuit diagram of the oil-water mixing and delivery system of the present invention.

FIG. 2 is a circuitry of the oil-water mixing and supplying system of this invention. The oil and water are drawn in by the delivery pump P5 through the check valve 5, with the oil passing through the oil regulating valve 1 and the solenoid valve 2 and with the water through the water regulating valve 3 and the solenoid valve 4. The delivery pump P5 has a flow regulating valve 6 parallelly connected thereto. The delivery pump P5 is connected on the delivery side to the check valve 7, the inline mixer 8, the solenoid valve 9 and to the burner $B_P$. In the case of a pump-incorporated burner, the excess fuel that was not used in the burner $B_P$ is returned to the inlet side of the inline mixture 8 through the check valve 10. For the burner without a pump, the excess fuel is returned to the suction side of the delivery pump P5 through the check valve 11, as indicated by the dotted line. Provided between the check valve 7 and the inline mixer 8 is a pressure accumulating vessel T3 for preventing abrupt pressure change in the piping. Reference numeral 12 represents a pressure detector. A circulation pump P6 and a check valve 13 are provided in the piping between the delivery side of the inline mixer 8 and the suction side of the delivery pump P5. Denoted by 14 is an air exhaust valve.

Before explaining the action of the device of this invention, the inline mixer 8 will be briefly introduced for your reference.

Figure 3:
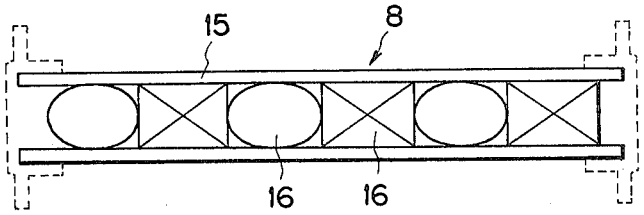
FIG. 3 PRIOR ART
FIG. 3 is an end view of an inline mixer known in the prior art.

FIG. 3 shows one example of the inline mixer, illustrating the internal structure of the Static Mixer (trademark) of Kenics Corp., U.S.A. This mixer has a pipe 15 in which a required number of agitator elements 16, each twisted clockwise or counterclockwise, are alternately lined up and secured to each other with the blades of the contacting elements set at right angles. This mixer has no movable parts.

Figure 4:
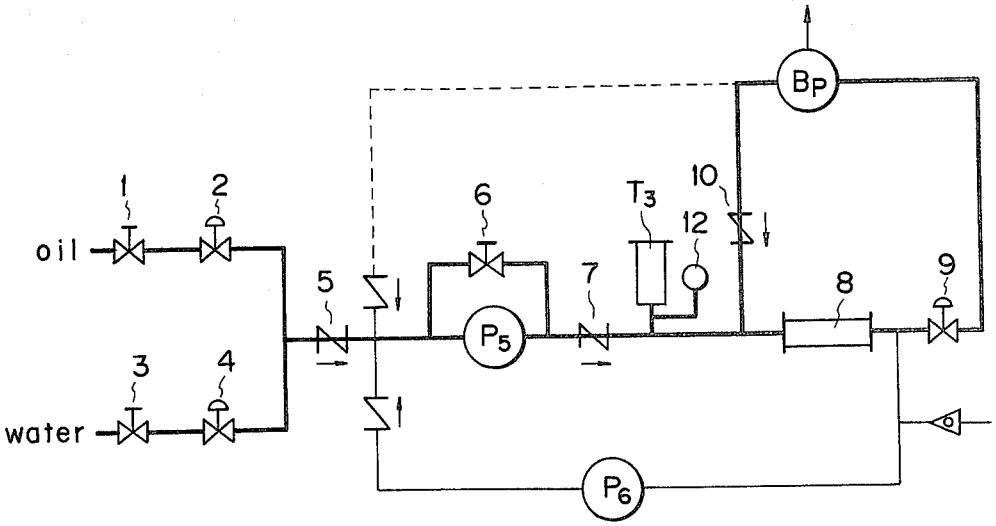
FIG. 4 is a circuit diagram of the present invention during normal oil-water flow when the burner is operational.

In FIG. 4, the normal action of the system illustrated in FIG. 2 is shown with the solid line. The delivery pump P5 draws the oil and water through the check valve 5, with the oil passing through the oil regulating valve 1 and the solenoid valve 2 and the water through the water regulating valve 3 and the solenoid valve 4. The flow rate of the water and oil is regulated by the regulating valve 6. The regulated flows of the oil and water are then delivered through the check valve 7 to the inline mixer 8 where they are mixed into an emulsion which is then supplied through the open-close valve 9 to the burner $B_P$. The excess fuel that was not used in the burner is returned to the inlet side of the inline mixer 8 through the check valve 10. (The above description refers to the pump-incorporated burner.)

Figure 5:
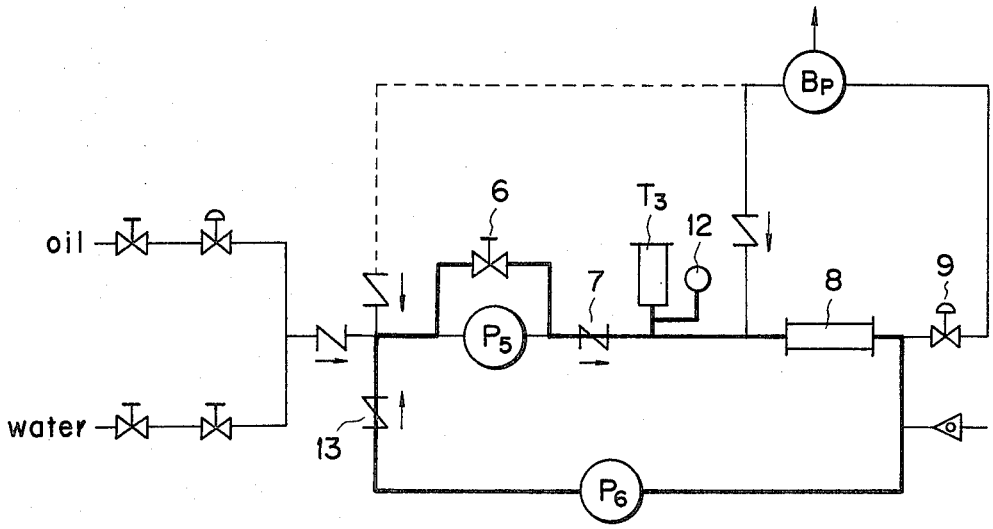
FIG. 5 is a circuit diagram of the present invention showing oil-water flow when the burner is not in operation.

The burner is turned on or off by the temperature control system. When the burner is not operating, if the emulsified fuel in the pipe is left stationary the emulsion will be separated into water and oil. To prevent this separation, the circulating pump P6 is operated while the burner is at halt. That is, as shown by the solid line in FIG. 5, the circulating pump P6 is operated to keep the emulsified fuel in the pipe, particularly after the mixer 8, from becoming separated so that at the resumption of combustion the separated oil and water will not be supplied to the burner. The amount of fuel mixture contained in the pipe between the open-close valve 9 and the burner $B_P$ is so small that it will have almost no effect on the burner.

Any change in pressure in the pipe can be absorbed by the pressure accumulating vessel T3. When an abnormal pressure increase is detected by the pressure detector 12, the pump is halted to let the fuel flow by the pressure accumulated in the pressure accumulating vessel T3.

Figure 1:
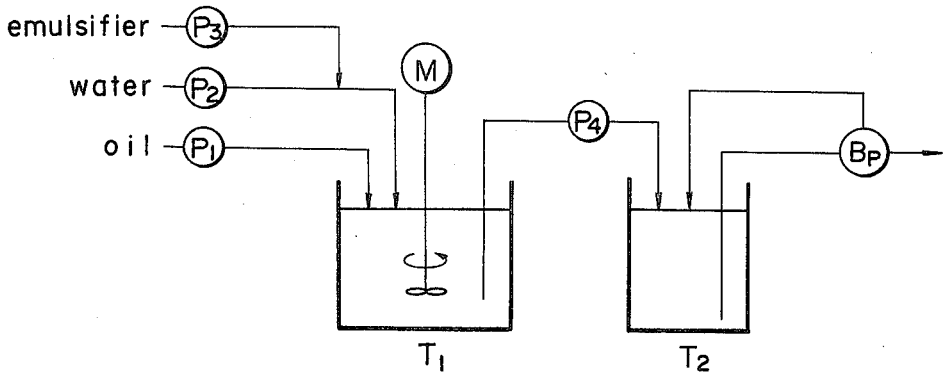
FIG. 1 PRIOR ART
FIG. 1 is a circuit diagram of a conventional oil-water mixing and delivery system, as previously discussed.

With the system of this invention, since the oil and water are drawn in by the delivery pump P5 in the amount corresponding to the opening area of the regulating valves, the proportion of oil and water is always constant (the flow rate may change according to the kind of fluid). So, compared with the conventional device as shown in FIG. 1 employing constant flow pumps, it is easy with this device to determine the ratio of mixture. The regulating valve 6 installed parallel with the delivery pump P5 not only mitigates the load of the pump P5 and enables fine flow adjustment but also serves as a bypass passage when the circulating pump P6 is operated. The open-close solenoid valves 2, 4 and 9 are opened or closed simultaneously.

Furthermore, the system of this invention has the following advantages. Unlike the conventional system of the batch type, the system of this invention is constructed as an inline system requiring no emulsifying tank or auxiliary tank. This enables small size and light weight and reduces the possibility of fire disaster (since it is not necessary to install a tank in the room, the system may not be subject to fire regulations). The use of an inline mixer makes the batch time very small thus preventing the separation of oil and water. The excess fuel can be returned in-line, so that the oil and water as much as necessary for combustion are supplied by the delivery pump P5. In addition, this device can be used whether or not the burner has a built-in pump. The system operation can be performed in accordance with the control of the combustor while preventing the fuel from becoming separated into oil and water.

I claim as my invention:

1. A system for supplying an oil-water mixture to a burner including apparatus for continuously emulsifying the mixture, comprising:

(a) a first flow circuit operative when said burner is operative including
oil supply means,
water supply means,
first means for pumping oil and water from said respective supply means to said burner when said burner is operative, including flow regulating means for limiting the flow of oil and water therethrough when said first pumping means is operative, and for providing a bypass passage for said oil and water when said first pumping means is inoperative,
means, disposed upstream of said burner, for mixing said oil and said water prior to being delivered to said burner, said mixing means including stationary agitator elements, and
means for accumulating excessive increases in flow pressure and means for detecting said flow pressure increases, said detecting means being operatively coupled with said accumulating means and said first pumping means to define an auxiliary pumping means, whereby when said burner is operative, actuation of said detecting means causes inactivation of said first pumping means, and release of the excess pressure in said accumulating means into said first flow circuit, thereby maintaining the flow of said oil and water therethrough;

(b) a second flow circuit operative when said burner is inoperative including
said mixing means, and
second means for pumping said oil and said water, said second pumping means being positioned downstream of said mixing means and providing continuous circulation of said mixed oil and water through said mixing means, thereby maintaining emulsification of said oil and said water while said burner is inoperative; and (c) means for switching from said first flow circuit to said second flow circuit, located in said first circuit, and including means for detecting increases in flow pressure in said first circuit and means for absorbing abnormal increases in pressure in said first circuit.

* * * * *